US009963213B1

(12) United States Patent
Jaszewski et al.

(10) Patent No.: US 9,963,213 B1
(45) **Date of Patent: *May 8, 2018**

(54) MOUNTING SYSTEMS FOR OUTBOARD MOTORS

(71) Applicant: Brunswick Corporation, Lake Forest, IL (US)

(72) Inventors: Wayne M. Jaszewski, Jackson, WI (US); Andrew Tuchscherer, Wauwatosa, WI (US); Darin C. Uppgard, Oshkosh, WI (US); Paul A. Ekis, Berlin, WI (US)

(73) Assignee: Brunswick Corporation, Mettawa, IL (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/410,879

(22) Filed: Jan. 20, 2017

(51) Int. Cl.
*B63H 5/125* (2006.01)
*B63H 20/08* (2006.01)
*B63H 20/06* (2006.01)

(52) U.S. Cl.
CPC ..... *B63H 20/06* (2013.01)

(58) Field of Classification Search
CPC ..... B63H 20/02; B63H 20/06; B63H 2020/02
USPC ..... 440/53, 55, 57, 61 T, 61 F, 63, 65
See application file for complete search history.

(56) References Cited

U.S. PATENT DOCUMENTS 3,961,595 A * 6/1976 Meyer ..... B63H 21/305 440/52
4,669,698 A * 6/1987 McGuire ..... B63H 20/06 248/641
5,238,433 A 8/1993 Hayasaka et al.
5,355,821 A * 10/1994 Johnson ..... B63H 21/265 114/144 R
5,707,263 A 1/1998 Eick et al.
6,146,220 A 11/2000 Alby et al.
6,419,534 B1 7/2002 Helsel et al.
6,454,620 B1 9/2002 Theisen et al.
6,656,003 B1 12/2003 Kitsu et al.
(Continued)

OTHER PUBLICATIONS

Grassi et al., "The Ablation Casting Process," journal article, Apr. 17, 2009, vols. 618-619, pp. 591-594 of Materials Science Forum, Switzerland.

(Continued)

*Primary Examiner* — Daniel V Venne
(74) *Attorney, Agent, or Firm* — Andrus Intellectual Property Law, LLP

(57) ABSTRACT

A system for mounting an outboard motor propulsion unit to a marine vessel transom is disclosed. The propulsion unit's midsection has an upper end supporting an engine system and a lower end carrying a gear housing. The mounting system includes a support cradle having a head section coupled to a transom bracket, an upper structural support section extending aftward from the head section and along opposite port and starboard sides of the midsection, and a lower structural support section suspended from the upper structural support section and situated on the port and starboard sides of the midsection. A pair of upper mounts couples the upper structural support section to the midsection proximate the engine system. A pair of lower mounts couples the lower structural support section to the midsection proximate the gear housing. At least one of the upper and lower structural support sections comprises an extrusion or a casting.

20 Claims, 14 Drawing Sheets

(56) References Cited

U.S. PATENT DOCUMENTS

| | | | | |
|---|---|---|---|---|
| 7,244,152 | B1 | 7/2007 | Uppgard | |
| 7,896,304 | B1 | 3/2011 | Eichinger et al. | |
| 8,820,701 | B1 | 9/2014 | Eichinger | |
| 9,205,906 | B1 | 12/2015 | Eichinger | |
| 9,302,756 | B1 | 4/2016 | Groeschel et al. | |
| 9,334,034 | B1 | 5/2016 | Waldvogel et al. | |
| 9,376,191 | B1 | 6/2016 | Jaszewski | |
| 9,446,828 | B1 | 9/2016 | Groeschel et al. | |
| 9,481,439 | B1 | 11/2016 | Groeschel et al. | |
| 9,623,948 | B1 * | 4/2017 | Waldvogel | B63H 21/305 |
| 9,643,703 | B1 * | 5/2017 | Eichinger | B63H 20/02 |
| 9,701,383 | B1 * | 7/2017 | Stuber | B63H 20/06 |
| 2017/0314110 | A1 * | 11/2017 | Grassi | C22F 1/04 |

OTHER PUBLICATIONS

Shiomi et al., "Reducing Vibration of a 2-Cylinder Outboard Motor by the Pendulum Motion Mount Method," technical paper, Nov.3 28-30, 2001, Small Engine Technology Conference and Exhibition, Pisa, Italy.

Waldvogel et al., "Stern Drives for Marine Vessels," Unpublished U.S. Appl. No. 14/714,418, filed May 18, 2015.

* cited by examiner

MOUNTING SYSTEMS FOR OUTBOARD MOTORS

FIELD

The present disclosure relates to mounting systems for outboard motors, and more specifically to mounting systems that are coupled to a midsection of a propulsion unit of an outboard motor.

BACKGROUND

U.S. Pat. No. 6,146,220, which is incorporated herein by reference, discloses an outboard motor mounted to a transom of a boat with a pedestal that is attached either directly to the transom or to an intermediate plate that is, in turn, attached to the transom. A motor support platform is attached to the outboard motor, and a steering mechanism is attached to both pedestal and the motor support platform. The tilting mechanism is attached to the motor support platform and to the outboard motor. The outboard motor is rotatable about a tilting axis relative to both the pedestal and the motor support platform. The tilting mechanism is rotatable relative to the pedestal and about a steering axis. The steering axis is generally vertical and stationary relative to the pedestal and is unaffected by the tilting of the outboard motor. The tilting mechanism is rotatable relative to the pedestal and about the steering axis with the outboard motor.

U.S. Pat. No. 6,419,534, which is incorporated herein by reference, discloses a support system for an outboard motor which uses four connectors attached to a support structure and to an engine system for isolating vibration from being transmitted to the marine vessel to which the outboard is attached. Each connector comprises an elastomeric portion for the purpose of isolating the vibration. Furthermore, the four connectors are disposed in a common plane which is generally perpendicular to a central axis of a driveshaft of the outboard motor. Although precise perpendicularity with the driveshaft axis is not required, it has been determined that if the plane extending through the connectors is within forty-five degrees of perpendicularity with the driveshaft axis, improved vibration isolation can be achieved. A support structure, or support saddle, completely surrounds the engine system in the plane of the connectors. All of the support of the outboard motor is provided by the connectors within the plane, with no additional support provided at a lower position on the outboard motor driveshaft housing.

U.S. Pat. No. 7,244,152, which is incorporated herein by reference, discloses an adapter system provided as a transition structure which allows a relatively conventional outboard motor to be mounted to a pedestal which provides a generally stationary vertical steering axis. An intermediate member is connectable to a transom mount structure having a connector adapted for mounts with central axes generally perpendicular to a plane of symmetry of the marine vessel. Many types of outboard motors have mounts that are generally perpendicular to this configuration. The intermediate member provides a suitable transition structure which accommodates both of these configurations and allows the conventionally mounted outboard motor to be supported, steered, and tilted by a transom mount structure having the stationary vertical steering axis and pedestal-type configuration.

U.S. Pat. No. 8,820,701, which is incorporated herein by reference, discloses a mounting arrangement for supporting an outboard motor with respect to a marine vessel extending in a fore-aft plane. The mounting arrangement comprises first and second mounts that each have an outer shell, an inner wedge concentrically disposed in the outer shell, and an elastomeric spacer between the outer shell and the inner wedge. Each of the first and second mounts extend along a axial direction, along a vertical direction that is perpendicular to the axial direction, and along a horizontal direction that is perpendicular to the axial direction and perpendicular to the vertical direction. The inner wedges of the first and second mounts both have a non-circular shape when viewed in a cross-section taken perpendicular to the axial direction. The non-circular shape comprises a first outer surface that extends transversely at an angle to the horizontal and vertical directions. The non-circular shape comprises a second outer surface that extends transversely at a different, second angle to the horizontal and vertical directions. A method is for making the mounting arrangement.

U.S. Pat. No. 9,376,191, which is incorporated herein by reference, discloses an outboard motor to be coupled to a transom of a marine vessel including a midsection housing having a front side configured to face the transom, a back side opposite the front side, a left side, and an opposite right side. An engine having an engine block is mounted directly to and supported by the midsection housing. A driveshaft is coupled in torque transmitting relation with a crankshaft of the engine, and a portion of the driveshaft is located exterior to the midsection housing. An exhaust pipe that conveys exhaust gas from an exhaust gas outlet of the engine downwardly away from the engine is also located exterior to the midsection housing. In one example, the midsection housing serves as a sump for engine oil.

SUMMARY

This Summary is provided to introduce a selection of concepts that are further described in the Detailed Description. This Summary is not intended to identify key or essential features of the claims subject matter, nor is it intended to be used as an aid in limiting the scope of the claimed subject matter.

According to one example of the present disclosure, a system for mounting an outboard motor propulsion unit to a transom of a marine vessel is disclosed. The propulsion unit has a midsection with an upper end configured to support an engine system and a lower end configured to carry a gear housing. The mounting system includes a support cradle. The support cradle has a head section configured to be coupled to a transom bracket, an upper structural support section extending aftward from the head section and configured to extend along the opposite port and starboard sides of the midsection, and a lower structural support section suspended from the upper structural support section and configured to be situated on the port and starboard sides of the midsection. A pair of upper mounts is configured to couple the upper structural support section to the midsection proximate the engine system by way of a pair of upper fasteners that extend in a port-starboard direction through a center aperture in each upper mount, respectively. A pair of lower mounts is configured to couple the lower structural support section to the midsection proximate the gear housing by way of a pair of lower fasteners that extend in the port starboard direction through a center aperture in each lower mount, respectively. At least one of the upper structural support section and the lower structural support section comprises one of an extrusion and a casting.

Another example of a system for mounting an outboard motor propulsion unit to a transom of a marine vessel includes a support cradle having a head section configured to be coupled to a transom bracket; an upper structural support section extending aftward from the head section and configured to extend along opposite port and starboard sides of the midsection; a lower structural support section suspended from the upper structural support section and configured to be situated on the port and starboard sides of the midsection; a first pair of extrusions respectively coupling port and starboard fore ends of the upper structural support section to port and starboard sides of the lower structural support section; and a second pair of extrusions respectively coupling port and starboard aft ends of the upper structural support section to the port and starboard sides of the lower structural support section. A pair of upper mounts is configured to couple the upper structural support section to the midsection proximate the engine system. A pair of lower mounts is configured to couple the lower structural support section to the midsection proximate the gear housing.

BRIEF DESCRIPTION OF THE DRAWINGS

The present disclosure is described with reference to the following Figures. The same numbers are used throughout the Figures to reference like features and like components.

DETAILED DESCRIPTION

In the present description, certain terms have been used for brevity, clarity and understanding. No unnecessary limitations are to be inferred therefrom beyond the requirements of the prior art because such terms are used for descriptive purposes only and are intended to be broadly construed. The different systems described herein may be used alone or with other systems known to those having ordinary skill in the art.

Figure 1:
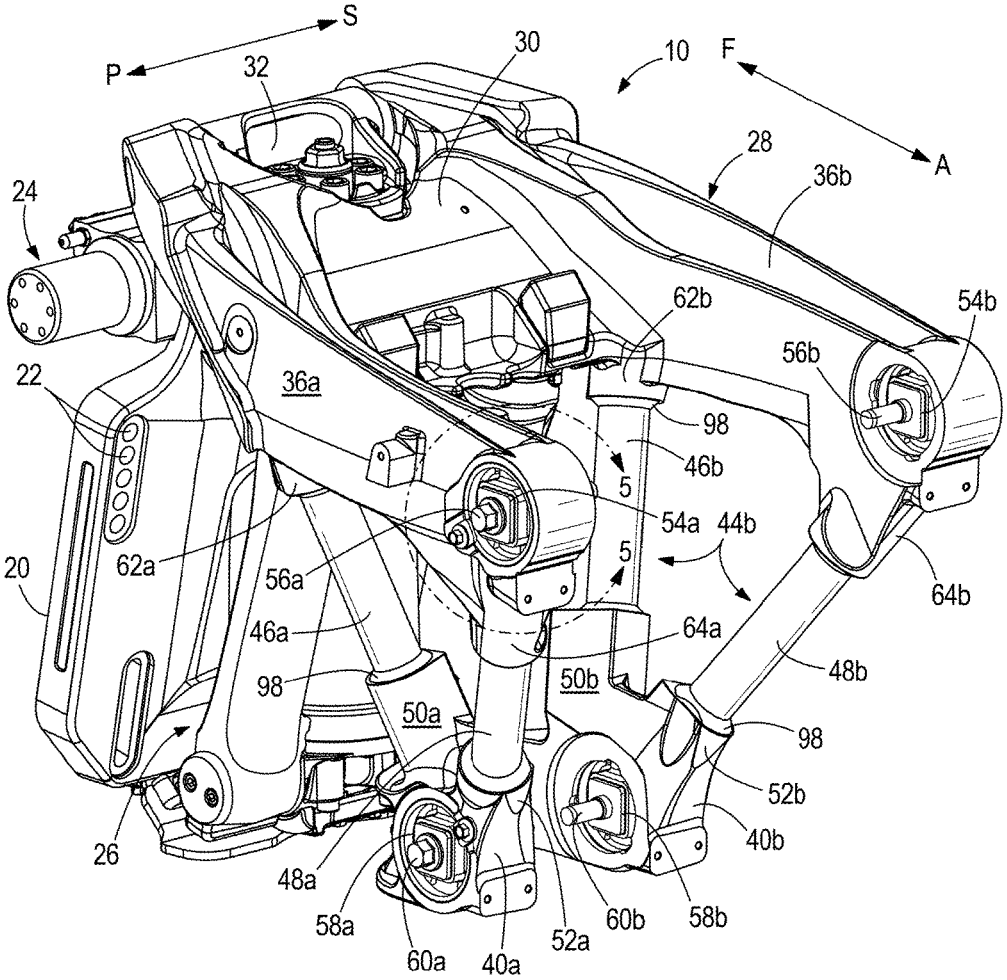
FIG. 1 illustrates a rear perspective view from a port side of a mounting system according to the present disclosure.
Figure 2:
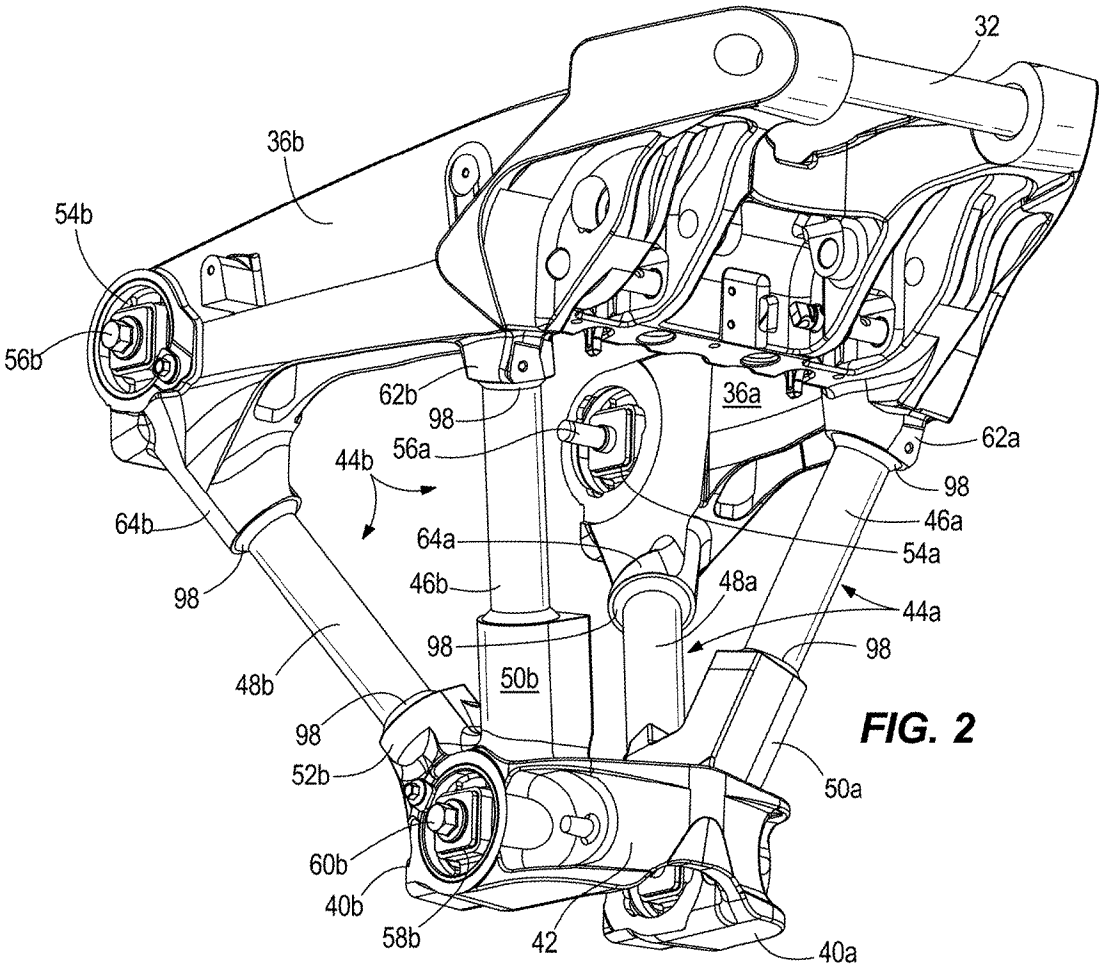
FIG. 2 illustrates a front perspective view from a starboard side of the mounting system.
Figure 3:
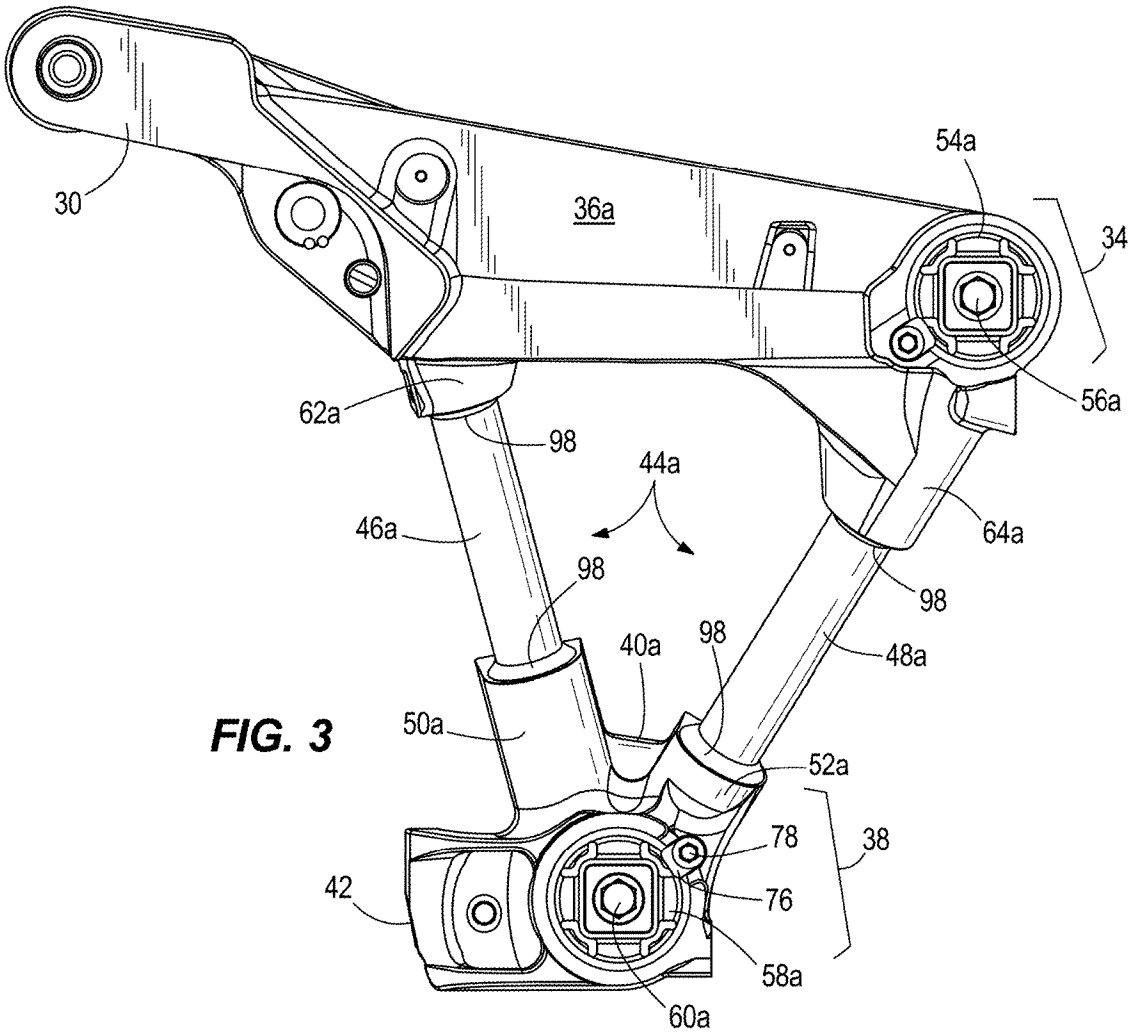
FIG. 3 illustrates a port-side view of the mounting system.
Figure 4:
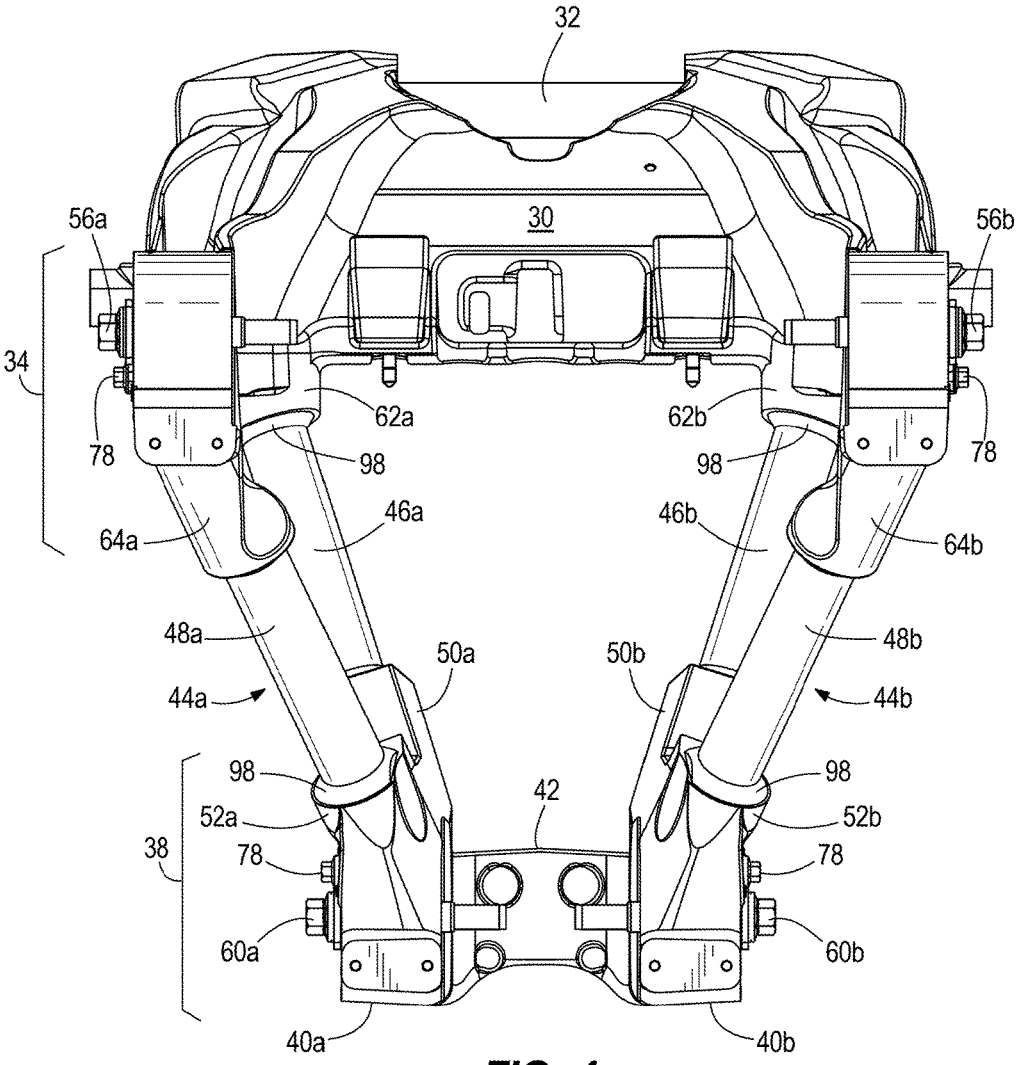
FIG. 4 illustrates a rear view of the mounting system.
Figure 7:
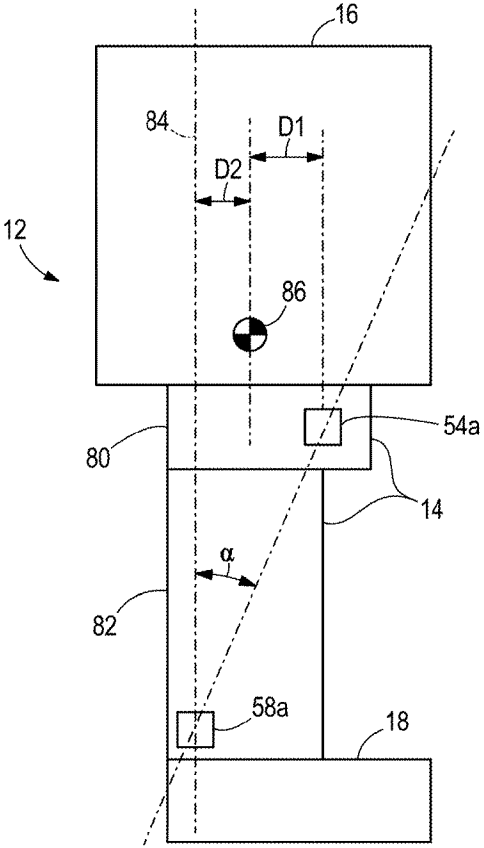
FIG. 7 schematically illustrates an arrangement of mounts on a propulsion unit according to the present disclosure.

FIG. 1 illustrates one example of a system 10 for mounting a propulsion unit of an outboard motor to a transom of a marine vessel. The mounting system 10 is defined in a port-starboard direction P—S and in a fore-aft direction F—A as shown by the arrows labeled with the same letters. Referring also to FIG. 7, the propulsion unit 12 includes a midsection 14 having an upper end configured to support an engine system 16 and a lower end configured to carry a gear housing 18. It should be understood that the propulsion unit 12 shown in FIG. 7 is highly schematic and does not include every feature of the outboard motor of the present disclosure. As is known, the propulsion unit 12 can be coupled to a transom of a marine vessel (not shown) by way of a transom bracket 20 (FIG. 1). The transom bracket 20 is coupled to the vessel transom by way of fasteners extending through apertures 22 in the transom bracket 20. A steering assembly 24 and a trim assembly 26 for the propulsion unit 12 can also be provided on the transom bracket 20.

Continuing with reference to FIGS. 1-4, the mounting system 10 may include a support cradle 28 having a head section 30 configured to be coupled to the transom bracket 20. Such coupling may be located at a foremost end of the head section 30, proximate the location of a tilt tube 32. The support cradle 28 includes an upper structural support section 34 extending aftward from the head section 30 and configured to extend along opposite port and starboard sides of the midsection 14 (see also FIG. 9). In this example, the upper structural support section 34 includes a pair of arms 36*a*, 36*b* extending aftward from the head section 30 and configured to extend along opposite port and starboard sides of the propulsion unit 12. The support cradle 28 also includes a lower structural support section 38 suspended from the upper structural support section 34 and configured to be situated on the port and starboard sides of the midsection 14. More specifically, the lower structural support section 38 includes a pair of Y-shaped yokes 40*a*, 40*b* on the port and starboard sides of the lower structural support section 38, respectively. Foremost portions of the pair of yokes 40*a*, 40*b* are joined together by a bracket portion 42.

The support cradle 28 also includes a pair of connector sections 44*a*, 44*b*. Each connector section 44*a*, 44*b* respectively couples a starboard side of the upper structural support section 34 to a starboard side of the lower structural support section 38, and a port side of the upper structural support section 34 to a port side of the lower structural support section 38. In the example shown in FIGS. 1-4, the pair of connector sections 44*a*, 44*b* comprises a first pair of tubular extrusions 46*a*, 46*b* respectively coupling port and starboard fore ends of the upper structural support section 34 to the port and starboard sides of the lower structural support section 38 and a second pair of tubular extrusions 48*a*, 48*b* respectively coupling port and starboard aft ends of the upper structural support section 34 to the port and starboard sides of the lower structural support section 38. A fore leg 50*a*, 50*b* of each yoke 40*a*, 40*b* is attached to a respective one of the first pair of tubular extrusions 46*a*, 46*b* and an aft leg 52*a*, 52*b* of each yoke 40*a*, 40*b* is attached to a respective one of the second pair of tubular extrusions 48*a*, 48*b*.

To accommodate the tubular extrusions 46*a*, 46*b* 48*a*, 48*b*, the upper structural support section 34 includes a fore pair of tubular receiving portions 62*a*, 62*b* respectively depending from the port and starboard fore ends of the upper structural support section 34 and respectively attached to the first pair of tubular extrusions 46*a*, 46*b*. An aft pair of tubular receiving portions 64*a*, 64*b* depends from the port and starboard aft ends of the upper structural support section 34, respectively, and is attached to the second pair of tubular extrusions 48*a*, 48*b*, respectively.

A pair of upper mounts 54*a*, 54*b* is configured to couple the upper structural support section 34 to the midsection 14 proximate the engine system 16 (i.e., just below the engine system 16) by way of a pair of upper fasteners 56*a*, 56*b* that extend in the port-starboard direction through a center aperture in each upper mount 54*a*, 54*b*. Thus, each upper mount 54*a*, 54*b* in the pair of upper mounts is configured to couple a respective arm 36*a*, 36*b* in the pair of arms to the propulsion unit 12. A pair of lower mounts 58*a*, 58*b* is configured to couple the lower structural support section 38 to the midsection 14 proximate the gear housing 18 (i.e., just above the gear housing 18) by way of a pair of lower fasteners 60*a*, 60*b* that extend in the port-starboard direction through a center aperture in each lower mount 58*a*, 58*b*. Thus, each lower mount 58*a*, 58*b* in the pair of lower mounts is configured to couple the propulsion unit 12 to the transom bracket 20 by way of the support cradle 28. Details of the upper and lower mounts 54*a*, 54*b* and 58*a*, 58*b* will be described further herein below.

FIGS. 1-4 illustrate a mounting system 10 in which a first pair of connectors (e.g., tubular extrusions 46*a*, 46*b*) couples the head section 30 of the support cradle 28 to a respective lower mount 58*a*, 58*b* in the pair of lower mounts. An upper end of each connector (e.g., tubular extrusion 46*a*, 46*b*) in the first pair of connectors is respectively connected to a fore end of a respective arm 36*a*, 36*b* in the pair of arms. A second pair of connectors (e.g., tubular extrusions 48*a*, 48*b*) couples an aft end of a respective arm 36*a*, 36*b* in the pair of arms to a respective lower mount 58*a*, 58*b* in the pair of lower mounts. Each upper mount 54*a*, 54*b* in the pair of upper mounts is respectively coupled to the aft end of a respective arm 36*a*, 36*b* in the pair of arms. The pair of upper mounts 54*a*, 54*b* and the pair of lower mounts 58*a*, 58*b* are configured to be coupled to the propulsion unit 12 by fasteners 56*a*, 56*b*, 60*a*, 60*b* that extend in the port-starboard direction of the propulsion unit 12.

Figure 5:
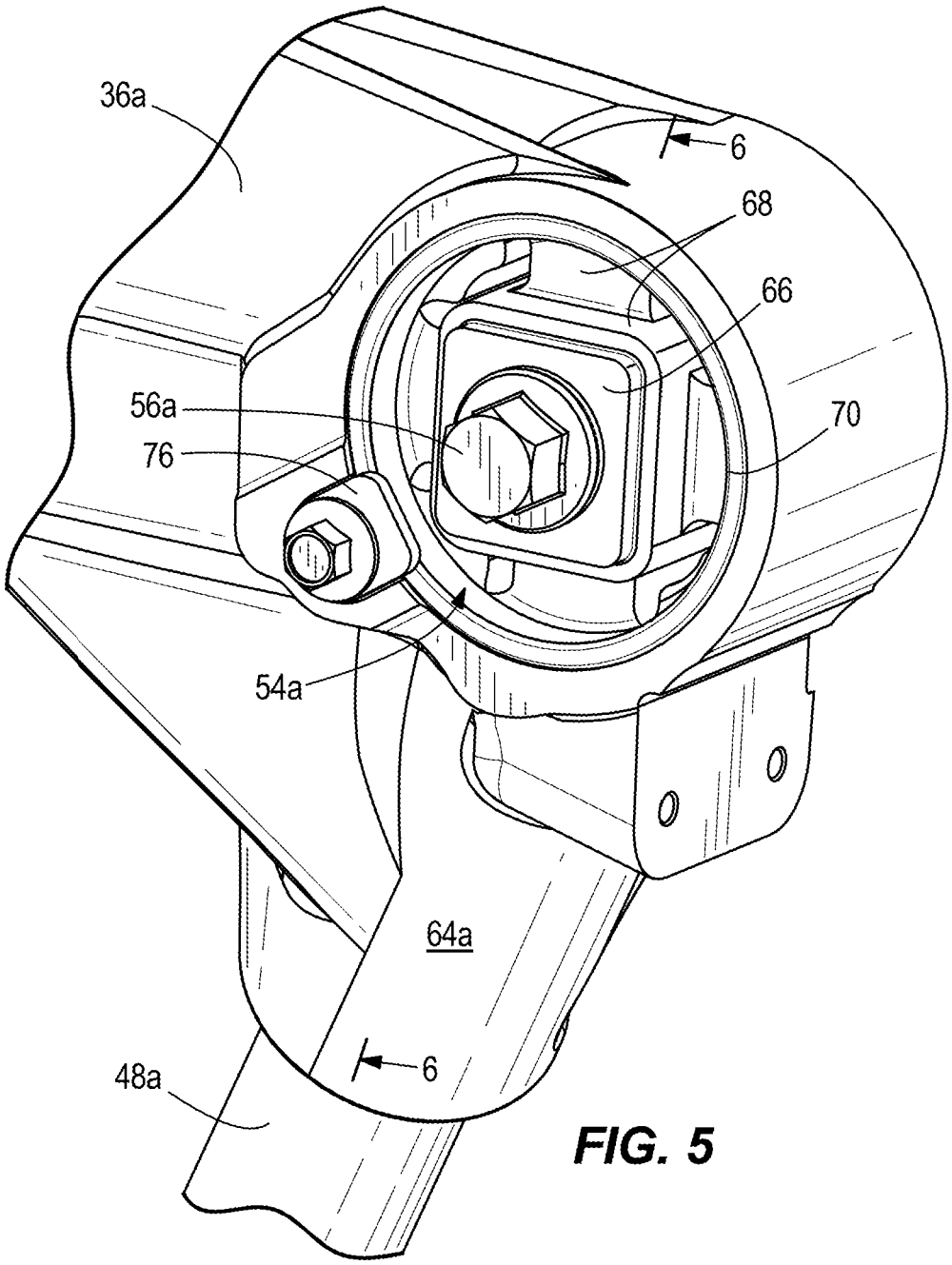
FIG. 5 illustrates a close-up view of the area noted in FIG. 1.
Figure 6:
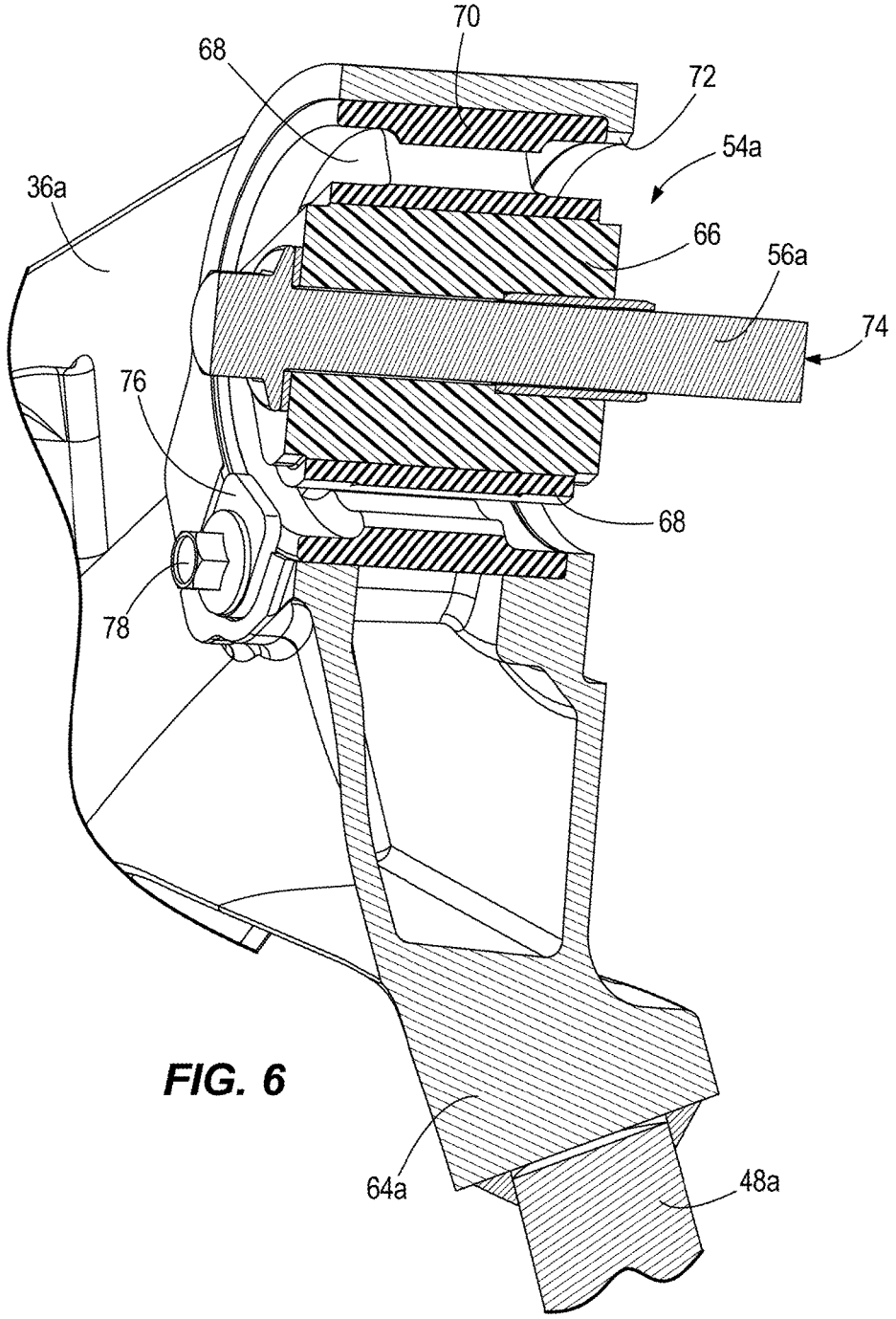
FIG. 6 illustrates a cross-section of the area 6-6 shown in FIG. 5.

FIG. 5 illustrates a detailed view of the aft end of the port-side arm 36*a* of the support cradle 28, where the upper mount 54*a* is located. FIG. 6 illustrates a cross-section through the upper mount 54*a* shown in FIG. 5. Although only the mount 54*a* will be described herein below in detail, it should be understood that the same description applies to the remainder of the mounts 54*b*, 58*a*, and 58*b*. The mount 54*a* includes a central shaft 66 with a cylindrical aperture that receives the fastener 56*a*. The shaft 66 is made of a non-elastomeric material in order to hold the fastener 56 tightly in the aperture therein. An elastomeric material 68 surrounds the shaft 66. In the present example, the elastomeric material has a somewhat cross-shaped structure, with four arms that connect to an outer shell 70. The shape of the elastomeric material 68 can provide different spring constants to the mount 54*a* depending on the direction in which the forces from the outboard motor are transferred to the mount 54*a*. The outer shell 70 is made of a non-elastomeric material, and is fitted into an aperture 72 in the aft end of the arm 36*a* of the support cradle 28. As is shown, the aperture 72 extends in a lateral, port-starboard direction, as do the mount 54*a* and the fastener 56*a*. An inner end 74 of the fastener 56*a* is configured to extend into the propulsion unit 12 to support and secure the propulsion unit 12 in the support cradle 28. For example, the inner end 74 of the fastener 56*a* can extend into the midsection 14, such as into the driveshaft housing or adapter plate, both of which will be described further herein below.

In the embodiment shown herein, each of the upper and lower mounts 54*a*, 54*b* and 58*a*, 58*b* in the pairs of upper and lower mounts comprises a non-elastomeric outer shell 70. A washer 76, such as a D-shaped washer, is provided for each of the upper and lower mounts 54*a*, 54*b* and 58*a*, 58*b*. The washer 76 is fastened to the respective upper or lower structural support section 34 or 38 (as shown in FIGS. 5 and 6, to the upper structural support section 34), and contacts the outer shell 70 of the respective upper or lower mount (here, upper mount 54*a*) in the port-starboard direction. The washer 76, by way of such contact and overlap with the outer shell 70 of the mount 54*a*, retains the respective upper or lower mount (here, upper mount 54*a*) in the respective upper or lower structural support section (here, upper structural support section 34). Additional details of the washer retention system can be seen in FIG. 17, along with the fastener 78 that holds the washer 76 to the structural support section 34 or 38.

Figure 8:
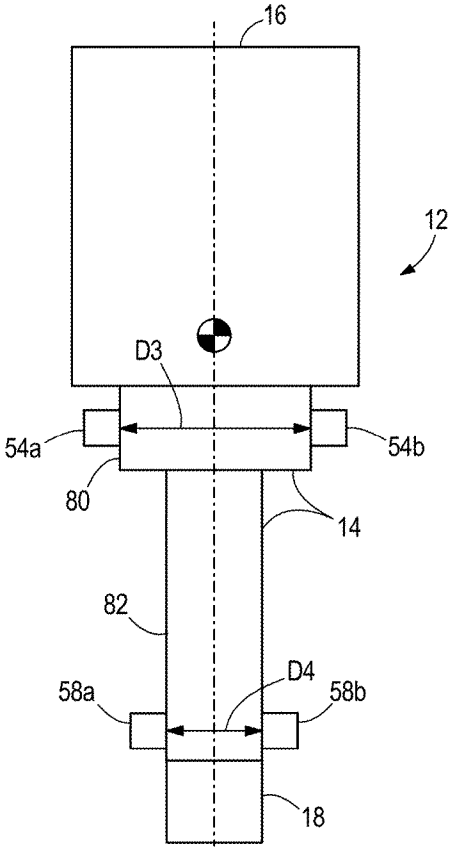
FIG. 8 is a rear view of the schematic shown in FIG. 7.

A unique aspect of the design of the present disclosure, shown in FIGS. 1-6, will now be described with respect to FIGS. 7 and 8. FIG. 7 shows a side view of a schematically-illustrated propulsion unit 12 of an outboard motor. Here, the engine system 16, including engine, associated electronics, upper exhaust system, and other engine-related components, is attached to the top surface of the midsection 14, and more specifically to an adapter plate 80. In alternative embodiments, the adapter plate 80 is not present, and the engine block of the engine system 16 sits directly atop a driveshaft housing, as described with respect to U.S. Pat. No. 9,367,191, which was incorporated by reference above. In this example, the adapter plate 80 is attached to the top of a driveshaft housing 82, and the gear housing 18 is attached to the bottom of the driveshaft housing 82. FIG. 7 shows the propulsion unit 12 in a neutral position, in which the propulsion unit 12 is generally vertically upright and not tilted or trimmed with respect to a transom of a marine vessel to which it may be attached. In other words, a crankshaft of the engine system 16 and the driveshaft extend along a vertical axis 84, which extends through the engine system 16, the adapter plate 80, the driveshaft housing 82, and into the gear housing 18, where it intersects with a propeller shaft axis (not shown) for a propeller shaft that holds a propeller.

In FIG. 7, the propulsion unit 12 is oriented such that its fore side is on the left and its aft side is on the right. According to the present disclosure, the pair of upper mounts (only port upper amount 54*a* being shown in the drawing, but starboard upper mount 54*b* being directly in line with it on the other side of the propulsion unit 12) is located aft of the pair of lower mounts (see port lower mount 58*a*, wherein starboard lower mount 58*b* is located similarly on the opposite side of the propulsion unit 12) when the propulsion unit 12 is in the neutral position. Note that both pairs of mounts are shown in FIG. 8, which is a rear view of the propulsion unit 12. Notably, the pair of upper mounts (in line with mount 54*a*) are located aft of a center of gravity 86 of the engine system 16. More specifically, with brief reference to FIG. 9, the pair of upper mounts 54*a*, 54*b* is located on a lateral side of the adapter plate 80 or driveshaft housing 82 (as the case may be), near the aft end of that lateral side.

Figure 9:
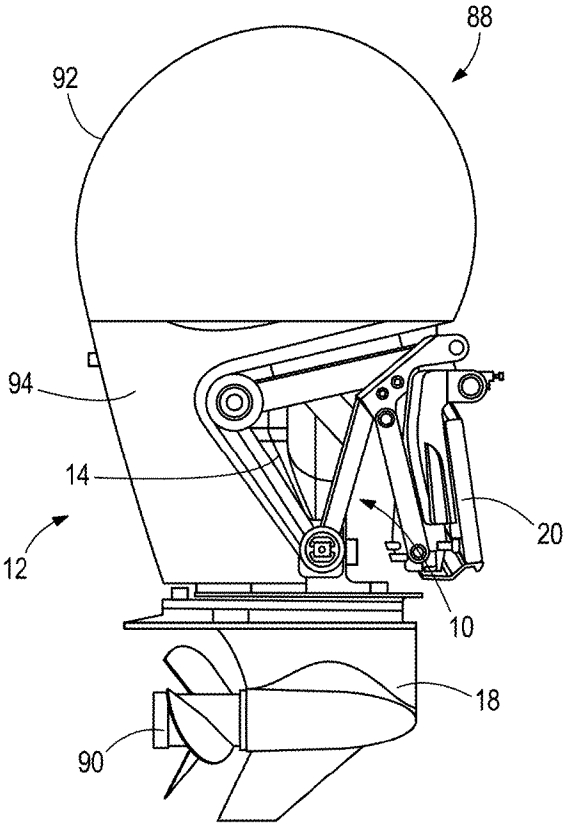
FIG. 9 illustrates a starboard-side view of an outboard motor according to the present disclosure.

Referring to FIGS. 7 and 9, the pair of lower mounts 58*a*, 58*b* is configured to be coupled fore of the center of gravity 86 and toward the front of a lateral side of the driveshaft housing 82. In one example, when the propulsion unit 12 is in the neutral position, the pair of upper mounts 54*a*, 54*b* is configured to be located at a predetermined horizontal distance D1 aft of the engine system's center of gravity 86, and the pair of lower mounts 58*a*, 58*b* is configured to be located at approximately the same predetermined distance D2 fore of the center of gravity 86. The distance D1 may be exactly the same as the distance D2 such that D1=D2, the distance D1 may be ±10 percent of the distance D2, or the distance D1 may be ±5 percent of the distance D2. Note too, that when the propulsion unit 12 is in the neutral position, the pair of lower mounts 58*a*, 58*b* is configured to be located approximately vertically in line with the vertical axis 84 of the crankshaft of the engine system 16 when viewed from the port or starboard side (here, port side) of the propulsion unit 12.

Other geometric relationships between the pair of upper mounts 54*a*, 54*b* and the pair of lower mounts 58*a*, 58*b* may also be described. For example, the pair of upper mounts 54*a*, 54*b* may be between 20° and 40° degrees aft of the pair of lower mounts 58*a*, 58*b* when the propulsion unit 12 is in the neutral position. See angle α in FIG. 7. In other examples, a is between 25° and 35°. More specifically, a may be approximately equal to 30°. In general, the pair of upper mounts 54*a*, 54*b* is located closer to an aft side of the midsection 14 than to a fore side of the midsection 14, and the pair of lower mounts 58*a*, 58*b* is located closer to the fore side of the midsection 14 than to the aft side of the midsection 14. FIG. 8 shows how the upper mounts 54*a*, 54*b* in the pair of upper mounts are spaced from one another in a port-starboard direction by a first distance D3, and the lower mounts 58*a*, 58*b* in the pair of lower mounts are spaced from one another in the port-starboard direction by way of a second distance D4. In one example, the second distance D4 is less than or approximately equal to half the first distance D3. In another example, the second distance D4 is approximately equal to half the first distance D3±10 percent. In another example, the second distance D4 is approximately equal to half the first distance D3±5 percent.

The arrangement of the upper and lower mounts 54*a*, 54*b* and 58*a*, 58*b* provides a balance of functional attributes, such as transmission of thrust loads, favorable vibration isolation characteristics, and limitation of gross engine movements during operation, while still accommodating tight packaging requirements on vessels that have multiple outboard motors coupled to their transoms. These qualities are provided by virtue of the fact that the mounts 54*a*, 54*b* and 58*a*, 58*b* are offset from one another in both the vertical and horizontal directions, and are connected by a plane rotated about 30° clockwise from vertical when viewed from a port side of the propulsion unit 12. The upper mounts 54*a*, 54*b* are located significantly aft of the lower mounts 58*a*, 58*b*, and are positioned behind the center of gravity 86 of the engine system 16. The lower mounts 58*a*, 58*b* are located approximately in line with the crankshaft axis 84 and approximately equidistant to the upper mounts 54*a*, 54*b* on an opposite side of the center of gravity 86. The upper mounts 54*a*, 54*b* are spaced at least twice as wide as the lower mounts 58*a*, 58*b*. The mounts 54*a*, 54*b* and 58*a*, 58*b* may be located vertically below the powerhead cowling and attached to either the adapter plate 80 or the driveshaft housing 82 and related midsection components. More specifically, in one example, referring briefly to FIG. 9, the pair of upper mounts 54*a*, 54*b* and the pair of lower mounts 58*a*, 58*b* are both configured to be located externally of a main casing/cowl 92, 94 of the propulsion unit 12. The mount arrangement of the present disclosure is compatible with either a pedestal mount, as disclosed in U.S. Pat. No. 6,146,220, which was incorporated by reference above, or with a conventional swivel bracket, as shown in the Figures herein.

The presently-disclosed mount layout achieves excellent vibration isolation while maintaining low lateral displacements for multi-engine packaging applications. Because the upper and lower mounts 54*a*, 54*b* and 58*a*, 58*b* are placed equidistant from the center of gravity 86 in the fore-aft direction, modal decoupling may be achieved for improved transmitted vibration performance. Because the propulsion unit 12 as a rigid body has six modes (three translational and three rotational), each of which has a unique frequency of occurrence, these modes can be de-coupled from one another and purposefully re-coupled together in specific ways for isolation from the vessel. In the example of the present disclosure, the fore-aft and pitch (rotation about the lateral axis) modes are coupled together as well as the lateral and roll (rotation about the longitudinal axis) modes. The yaw (rotation about the vertical axis) and vertical (bounce) modes are decoupled from the other modes.

The vertical location of the lower mounts 58*a*, 58*b*, which are far from the roll axis, provides for increased lateral mount stroke, which provides more practical mount snubbing opportunities to reduce lateral engine motion. The wide lateral spacing of the upper mounts 54*a*, 54*b* allows for an increase in roll stiffness, thereby reducing lateral displacements to help accommodate tight packaging requirements for multi-engine applications.

As already described somewhat herein above, FIG. 9 shows an example of an outboard motor 88 including a mounting system 10 and a propulsion unit 12, wherein the mounts 54*a*, 54*b* and 58*a*, 58*b* are attached to outer lateral sides of the midsection 14 at an upper aft end and a lower fore end of the midsection 14, respectively. The outboard motor 88 illustrated herein also includes a propeller 90 supported by way of a shaft extending through the gear housing 18 and an upper cowl 92 that covers and protects the engine system 16. A lower cowl 94 is included to cover various components located aft of the midsection 14, such as an exhaust system, as described with respect to U.S. Pat. No. 9,376,191.

Figure 10:
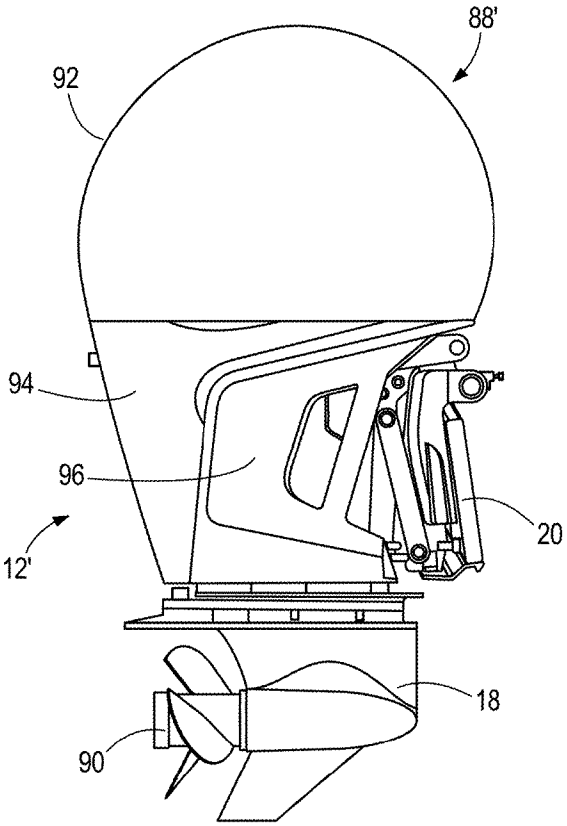
FIG. 10 illustrates a starboard-side view of another embodiment of an outboard motor.

In contrast to the outboard motor 88 of FIG. 9, the outboard motor 88' of FIG. 10 includes an additional cover 96 that encloses the pair of lower mounts 58*a*, 58*b*; at least the port and starboard aft ends of the upper structural support section 34 of the support cradle 28; and at least the port and starboard aft ends of the lower structural support section 38 of the support cradle 28. In this example, the cover 96 meets the lower cowl 94 and fully covers the midsection 14. The cover 96 is formed around the first and second tubular extrusions 46*a*, 46*b* to protect these components as well.

According to the present disclosure, various configurations are contemplated for the support cradle 28 and for the protection for the propulsion unit 12, including upper cowl 92, lower cowl 94, and optional cover 96. In each of the examples described herein above and about to be described herein below, at least one of the upper structural support section 34 and the lower structural support section 38 comprises one of an extrusion and a casting. In the example of FIGS. 1-6, the head section 30 and the upper structural support section 34 of the support cradle 28 are a first unitary casting, and the lower structural support section 38 is a second unitary casting. As noted, the pair of connector sections 44*a*, 44*b* comprises extrusions, such as tubular extrusions 46*a*, 46*b* and 48*a*, 48*b*. The connector sections 44*a*, 44*b* in the pair of connector sections may be one of welded and structurally adhered to the upper and lower structural support sections 34, 38. Such welds or structurally adhered joints are shown at 98 in FIGS. 1-6. In order to allow the parts to be placed correctly relative to each other during manufacturing, either the upper or lower end of each tubular extrusion 46*a*, 46*b* and 48*a*, 48*b* can be fitted into the casting of the upper or lower structural support section 34, 38, as appropriate, such as in the fore pair of tubular receiving portions 62*a*, 62*b*, in the aft pair of tubular receiving portions 64*a*, 64*b*, or in the fore or aft legs 50*a*, 50*b* and 52*a*, 52*b*. After being fit into the upper or lower casting, as appropriate, the weld or structural adhesive may be applied.

Figure 11:
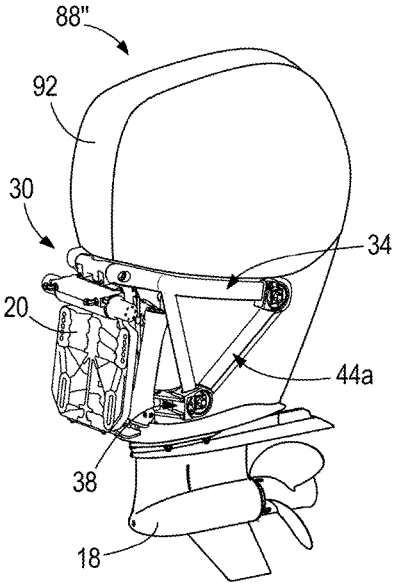
FIGS. 11-14 illustrate further embodiments of outboard motors according to the present disclosure.
Figure 12:
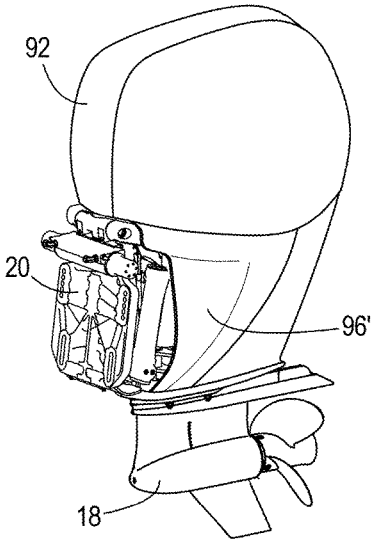

In yet another example of the outboard motor 88", shown in FIG. 11, the head section 30, the upper structural support section 34, the lower structural support section 38, and the pair of connector sections 44*a*, 44*b* of the support cradle 28 comprise extrusions and/or stamped or cut fabrications that are one of welded and structurally adhered to one another. In this example, no cover is provided for the support cradle 28. In the example of FIG. 12, however, a cover 96' is provided over at least the pair of lower mounts 58*a*, 58*b*, over the port and starboard aft ends of the upper structural support section 34, and over the port and starboard aft ends of the lower structural support section 38.

Figure 13:
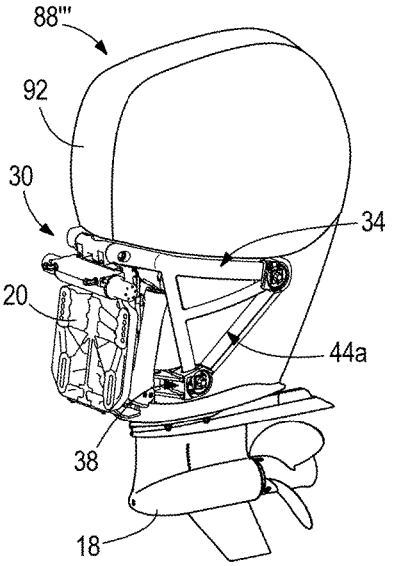
Figure 14:
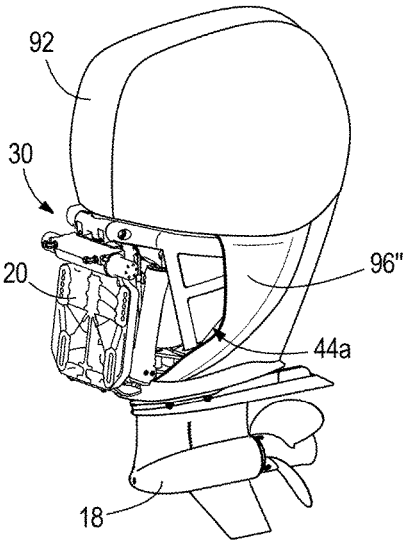
Figure 15A:
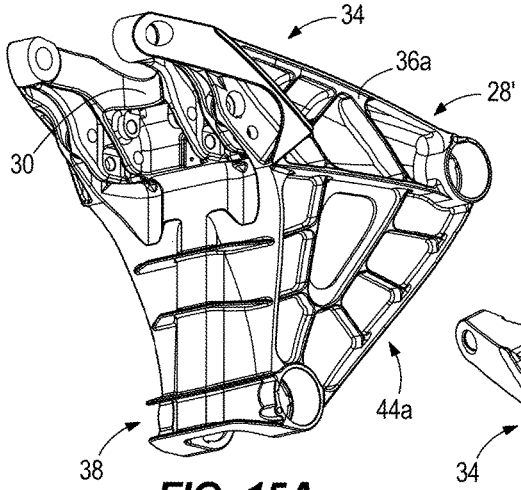
FIGS. 15A, 15B and 16A, 16B illustrate examples of a support cradle according to the present disclosure.
Figure 15B:
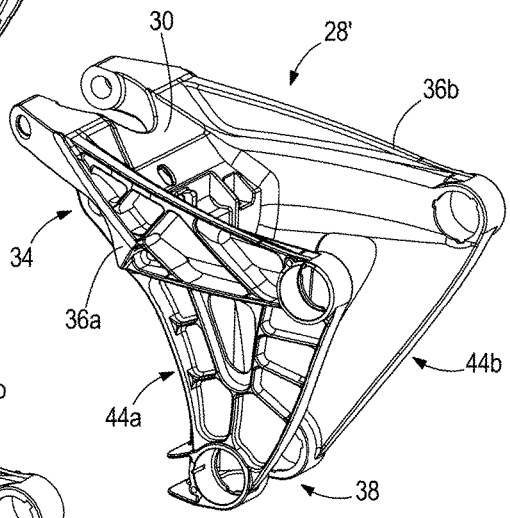
Figure 16A:
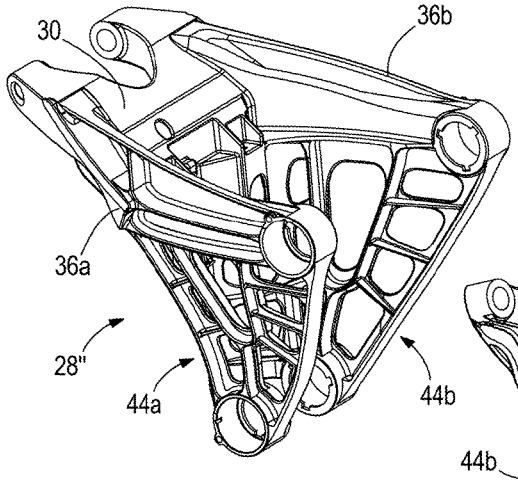
Figure 16B:
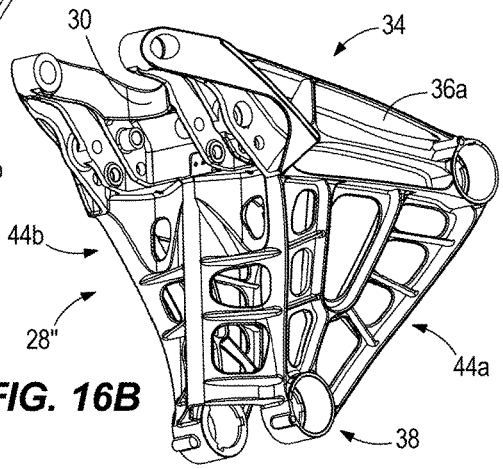

In yet another example of the outboard motor, as shown at 88'" in FIG. 13, the head section 30, the upper structural support section 34, the lower structural support section 38, and the pair of connector sections 44*a*, 44*b* of the support cradle 28 are a unitary casting. FIG. 14 shows how the unitary casting can be at least partially covered with a cover 96", which covers at least the pair of lower mounts 58*a*, 58*b*, the port and starboard aft ends of the upper structural support section 34, and the port and starboard aft ends of the lower structural support section 38.

FIGS. 15A and 15B and 16A and 16B show two examples of a support cradle 28', 28" that is a unitary casting. In the examples shown, the unitary casting may be an ablation, permanent mold, or high pressure die casting. Although each of the components will not be described separately herein, the head section 30, the upper structural support section 34, the arms 36*a*, 36*b*, and the lower structural support section 38 are illustrated and labeled for purposes of orienting the reader.

Figure 17:
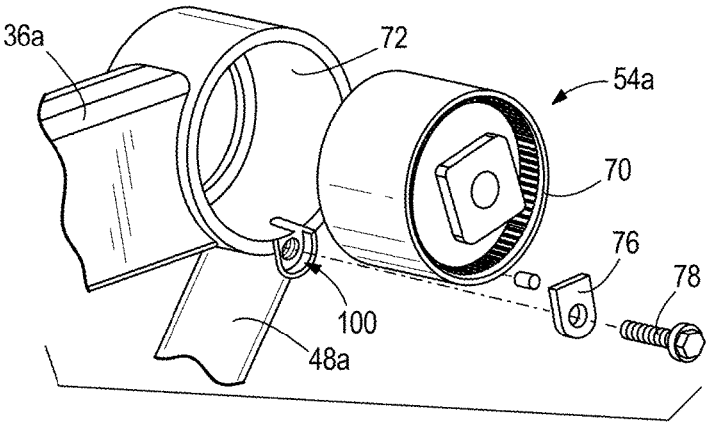
FIGS. 17-21 illustrate various examples of mounts according to the present disclosure.

Various configurations for the upper and lower mounts 54*a*, 54*b* and 58*a*, 58*b* are shown in FIGS. 17-21. The mount 54*a*, which was described herein above with respect to FIGS. 5 and 6 in great detail, is shown in FIG. 17 in an exploded view, so that the washer 76 and fastener 78, and their orientation with respect to the aperture 72 in the upper support section 34, can be seen. A receiving area 100 for the washer 76 and fastener 78 is also shown.

Figure 18:
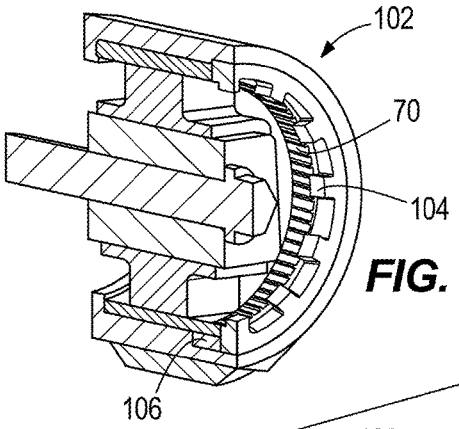

FIG. 18 illustrates an example in which the mount 102 includes a spanner nut 104 and a dowel 106, which cooperate with one another to hold the mount 102 in the aperture 72. The remainder of the mount 102, including the elastomeric and non-elastomeric portions and the fastener through the center aperture, are the same as that described herein above.

Figure 19:
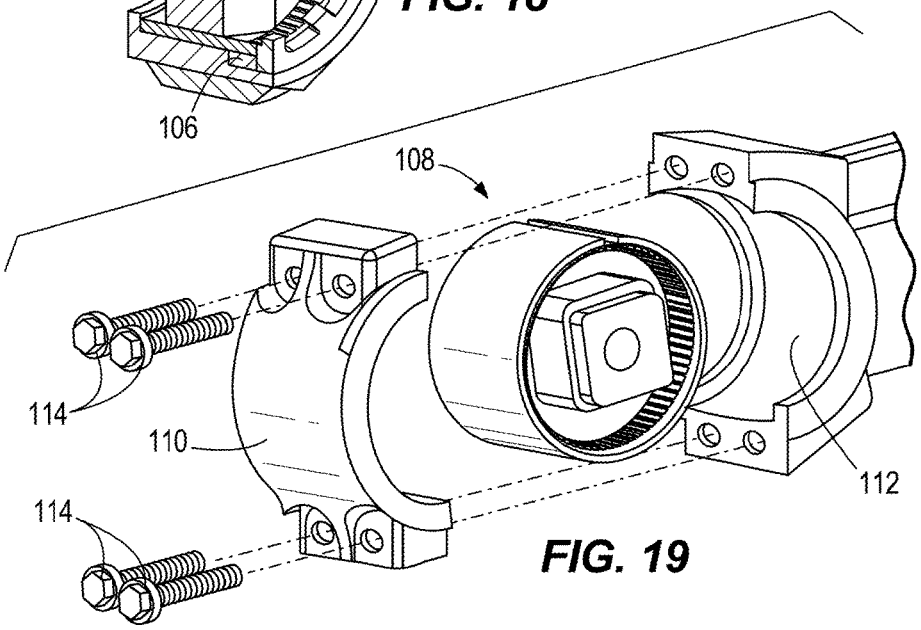

FIG. 19 illustrates an exploded view of a mount 108 that includes a bearing cap 110 held to a receiving portion 112 connected to or molded as part of the upper or lower structural support section 34, 38. The bearing cap 110 is held to the receiving portion 112 by a number of fasteners 114. The combined elastomeric and non-elastomeric portions of the mount 108 are held between the bearing cap 110 and the receiving portion 112 upon tightening of the fasteners 114. A similar design is disclosed in U.S. Pat. No. 8,820,701, which was incorporated by reference herein above.

Figure 20:
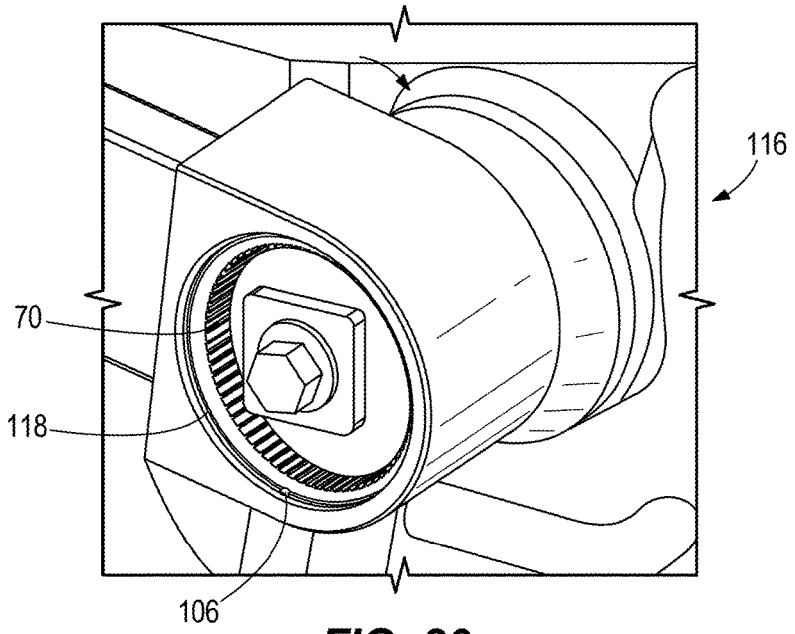

FIG. 20 illustrates an example of a mount 116 including a snap ring 118 and a dowel 106. Again, other portions of the mount 116 are the same as those described herein above with respect to FIGS. 5 and 6.

Figure 21:
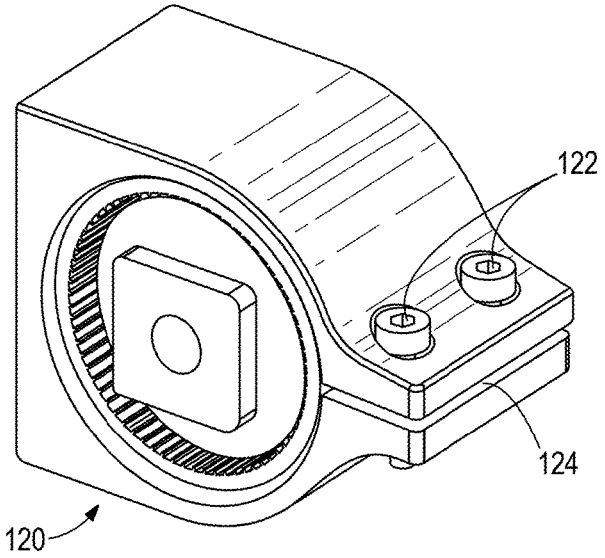

FIG. 21 illustrates an example in which the mount 120 is a swing-arm bolted split joint. Bolts 122 hold the split joint 124 together around the mount, situated in its aperture.

Note that any of the mounts described with respect to FIGS. 17-21 can be used as the upper, lower, or both the upper and lower mounts with the support cradles 28, 28', 28" described herein.

Figure 22:
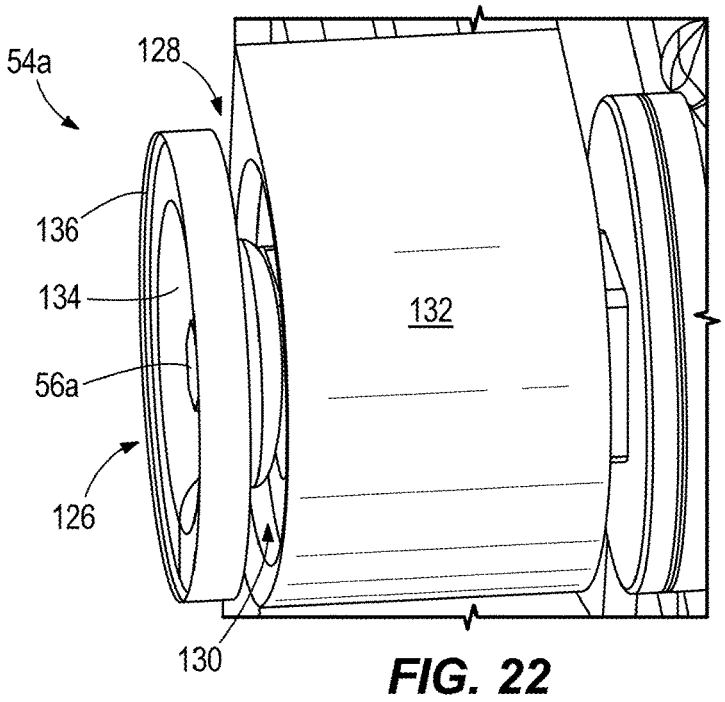
FIGS. 22-25 illustrate examples of mount snubbers according to the present disclosure.

Turning to FIG. 22, the mount, for example mount 54*a*, is shown in a close-up view. A snubber 126 is coupled to a laterally outer side 128 of the mount 54*a*. The mount 54*a* cannot be seen here, but is situated within a mount receiving area 130 of a structural portion 132 of the support cradle 28, which structural portion 132 may be one of the ends of the upper and lower structural support sections 34 or 38, as shown herein above. Although a snubber 126 is not shown on each of the mounts in the example mounting systems 10 shown herein, it should be noted that a pair of upper snubbers may be coupled to respective laterally outer sides of the upper mounts 54*a*, 54*b* in the pair of upper mounts, and a pair of lower snubbers may be coupled to respectively laterally outer sides of the lower mounts 58*a*, 58*b* in the pair of lower mounts. In other words, the port-side snubbers may be attached to the port sides of the port mounts 54*a*, 58*a*, and the starboard-side snubbers may be attached to the starboard sides of the starboard mounts 54*b*, 58*b*. The pairs of upper and lower snubbers may be attached to the laterally outer sides (see outer side 128) of the upper and lower mounts 54*a*, 54*b* and 58*a*, 58*b* by way of the pairs of upper and lower fasteners, 56*a*, 56*b* and 60*a*, 60*b*, which were described herein above. For example, the mount 54*a* and the snubber 126 shown in FIG. 22 are attached to the propulsion unit 12 by way of fastener 56*a* (see also FIG. 23). Each of the snubbers in the pairs of upper and lower snubbers is the same, but only the snubber 126 will be described with respect to FIG. 22 for purposes of illustration.

Figure 23:
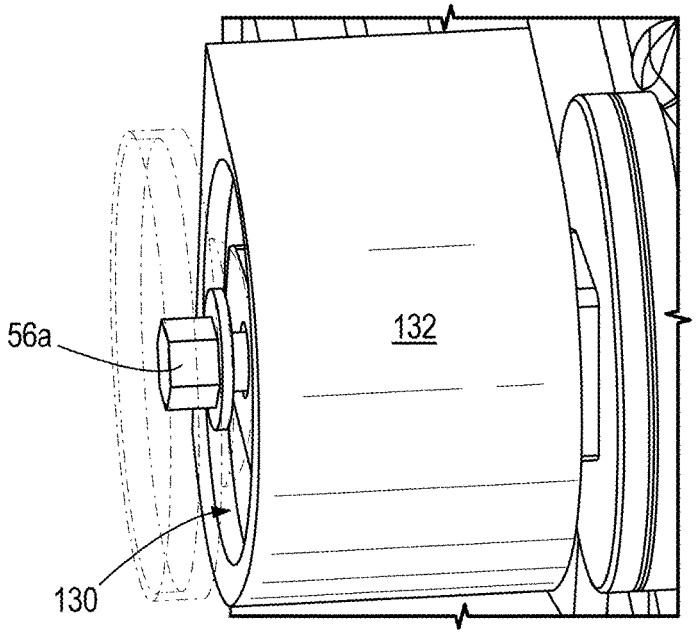

FIG. 23 shows the mount and snubber arrangement of FIG. 22, only with the snubber 126 shown in wire form in order to better show the mount receiving area 130 within the structural portion 132 and the fastener 56*a* that holds the snubber 126 to the laterally outer side of the mount 54*a*.

The snubber 126 comprises a non-elastomeric structural component, here roughly in the shape of a bowl with an outer, flatter flange, as shown at 134. The non-elastomeric component 134 is surrounded by a ring-shaped elastomeric isolation component 136. The non-elastomeric component 134 is configured to contact the upper mount 54*a* to which the snubber 126 is attached upon translation of the upper mount 54*a* in a laterally outward direction (here, a port direction) before the elastomeric component 136 contacts the respective upper mount 54*a*, if at all. The non-elastomeric component 134 allows for both sides of the support cradle 28 to stop motion in the lateral direction with the snubbers 126. For example, while the propulsion unit 12 moves in a port direction, the mounts 54*a*, 58*a* on the port side of the propulsion unit 12 will take up a portion of such lateral load. The snubbers 126 on the starboard side (i.e., on starboard mounts 54*b*, 58*b*) will be pulled upon, and will therefore also take up some of the port-directed load and transfer it to the support cradle 28 by way of the mounts 54*b*, 58*b*. This redistributes the load throughout the mounts 54*a*, 54*b* and 58*a*, 58*b* and the support cradle 28. The same is true of the port-side snubbers in the event of a starboard-directed load. The elastomeric component 136 provides NVH benefits as the contact between the non-elastomeric component 134 and the mount occurs. In one example, the component 134 is made of plastic. In another example, the component 134 is made of a material that is in fact elastomeric, but has a significantly higher durometer than the component 136.

Figure 24:
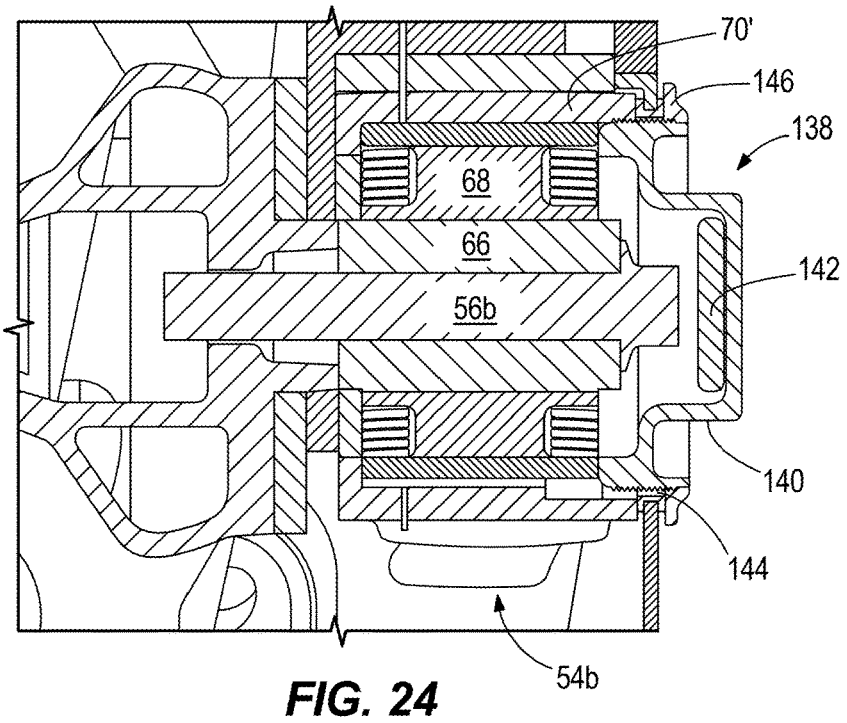

FIG. 24 illustrates a second example of a snubber 138, which in this example is attached to the laterally outer side of mount 54*b*. In this example, the non-elastomeric structural component 140 of the snubber 138 is shaped somewhat like a top hat, and the elastomeric isolation component 142 is shaped as a disc that sits inside the crown of the top hat.

Here, instead of being held to the mount 54*b* by way of the fastener 56*b*, the non-elastomeric component 140 is provided with threads 144 around its outer circumference that mate with a threaded area of the outer shell 70' of the mount 54*b*. An outer retaining ring 146 may be provided around the threads in order to retain the aesthetic cover and to provide a pleasing aesthetic.

Figure 25:
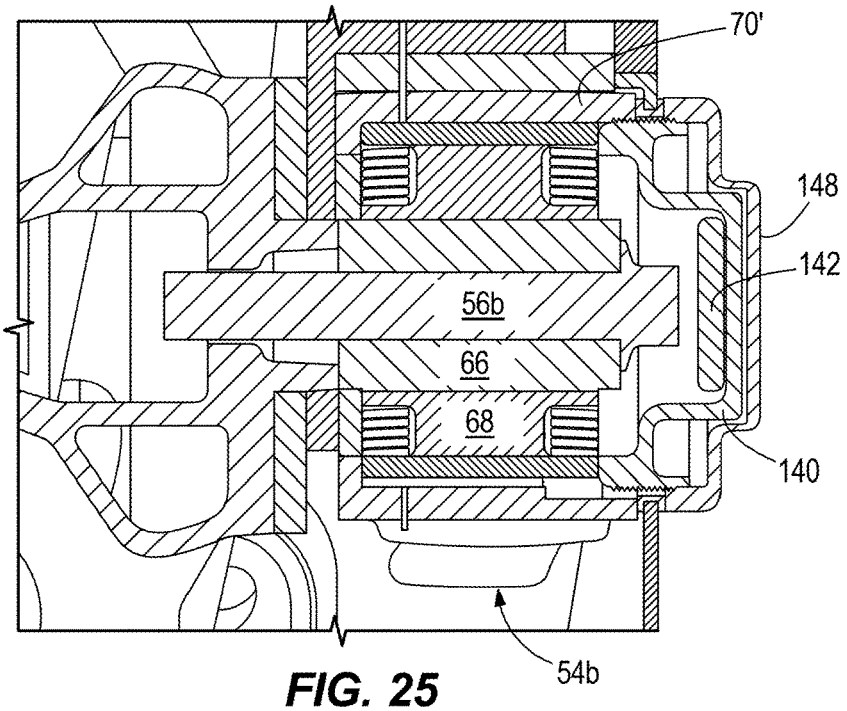

In another example, as shown in FIG. 25, an outer cap 148 may be provided around the non-elastomeric component 140, by way of inner threads on the cap 148. The cap 148 also prevents water intrusion and provides a pleasing aesthetic to the snubber assembly.

The mounting system 10 disclosed herein provides structural support for the isolation mounts 54*a*, 54*b* and 58*a*, 58*b*, which are in a unique configuration, by utilizing design and fabrication methods that have not been used in the marine outboard industry prior to now. Each of the weight, cost, assembly time and difficulty, and provision of service is improved with the present designs. Additionally, each embodiment has greater design flexibility due to the disclosed fabrication methods, when compared to traditional aluminum casting methods. The disclosed designs can utilize different manufacturing processes to lower production costs and reduce weight of the mounting system 10.

For example, as described with respect to FIGS. 1-6, the support cradle 28 may use a cast or forged aluminum head section 30, a cast or forged aluminum lower support section 38, and extruded tubes and/or fabricated connector sections 44*a*, 44*b*. Solid, cast aluminum may be used where there is complex machining required for the trim, tilt, and tilt lock features and where high structural strength is required. The remainder of the support cradle 28 may be fabricated from extruded tubes and/or fabricated plates, thereby allowing for optimization of the structure while maintaining a low weight.

In other examples, a completely fabricated aluminum component, which is welded or assembled with structural adhesive, can be used, as shown in FIGS. 11 and 12. This fabricated structure can be covered, as shown in FIG. 12, thereby allowing a minimum amount of the cradle to be exposed to the customer. Alternatively, a single piece cradle that has a structure optimized for ablation casting or advanced injection molding using a composite material containing fibers can be used, such as that shown and described with respect to FIGS. 13-16.

The isolation mount retention features, orientation features, and the form of the mounts themselves, as shown and described with respect to FIGS. 17-21 allow for easier service, tight packaging, and integration of decorative covers, as well as integration of snubbers, as described with respect to FIGS. 22-25.

The covers shown and described with respect to FIGS. 10, 12, and 14 can be made of plastic, and not only provide water diversion that protects the support cradle 28, but may also hold closed cell foam close to the mounting system 10, thereby providing enhanced NVH features.

Various other features and advantages of the present disclosure are shown in the drawings, and should be apparent to those having ordinary skill in the art.

In the above description, certain terms have been used for brevity, clarity, and understanding. No unnecessary limitations are to be inferred therefrom beyond the requirement of the prior art because such terms are used for descriptive purposes and are intended to be broadly construed. The different systems described herein may be used alone or in combination with other systems. It is to be expected that various equivalents, alternatives and modifications are possible within the scope of the appended claims. Each limitation in the appended claims is intended to invoke interpretation under 35 U.S.C. § 112(f), only if the terms "means for" or "step for" are explicitly recited in the respective limitation.

What is claimed is:

1. A mounting system for mounting an outboard motor propulsion unit to a transom of a marine vessel, the outboard motor propulsion unit having a midsection with an upper end configured to support an engine system and a lower end configured to carry a gear housing, the mounting system comprising:

a support cradle having:

a head section configured for coupling to a transom bracket;

an upper structural support section extending aftward from the head section and configured to extend along opposite port and starboard sides of the midsection; and a lower structural support section suspended from the upper structural support section and configured for situating on the port and starboard sides of the midsection;

a pair of upper mounts configured to couple the upper structural support section to the midsection proximate the engine system by way of a pair of upper fasteners that extend in a port-starboard direction through a center aperture in each upper mount, respectively; and a pair of lower mounts configured to couple the lower structural support section to the midsection proximate the gear housing by way of a pair of lower fasteners that extend in the port-starboard direction through a center aperture in each lower mount, respectively;

wherein at least one of the upper structural support section and the lower structural support section comprises one of an extrusion and a casting.

2. The mounting system of claim 1, wherein the support cradle further comprises a pair of connector sections, each connector section respectively coupling a starboard side of the upper structural support section to a starboard side of the lower structural support section, and a port side of the upper structural support section to a port side of the lower structural support section.

3. The mounting system of claim 2, wherein the head section and the upper structural support section of the support cradle are a first unitary casting.

4. The mounting system of claim 3, wherein the lower structural support section is a second unitary casting.

5. The mounting system of claim 4, wherein the pair of connector sections comprises extrusions.

6. The mounting system of claim 5, wherein the connector sections in the pair of connector sections are one of welded and structurally adhered to the upper and lower structural support sections.

7. The mounting system of claim 5, wherein the pair of connector sections comprises:

a first pair of tubular extrusions respectively coupling port and starboard fore ends of the upper structural support section to the port and starboard sides of the lower structural support section; and a second pair of tubular extrusions respectively coupling port and starboard aft ends of the upper structural support section to the port and starboard sides of the lower structural support section.

8. The mounting system of claim 7, wherein:

the lower structural support section comprises a pair of Y-shaped yokes on the port and starboard sides of the lower structural support section, respectively;

foremost portions of the pair of yokes are joined together by a bracket portion;

a fore leg of each yoke is attached to a respective one of the first pair of tubular extrusions; and an aft leg of each yoke is attached to a respective one of the second pair of tubular extrusions.

9. The mounting system of claim 7, wherein the upper structural support section comprises:

a fore pair of tubular receiving portions respectively depending from the port and starboard fore ends of the upper structural support section and respectively attached to the first pair of tubular extrusions; and an aft pair of tubular receiving portions respectively depending from the port and starboard aft ends of the upper structural support section and respectively attached to the second pair of tubular extrusions.

10. The mounting system of claim 2, wherein the head section, the upper structural support section, the lower structural support section, and the pair of connector sections of the support cradle are a unitary casting.

11. The mounting system of claim 10, wherein the unitary casting is an ablation casting.

12. The mounting system of claim 2, wherein the head section, the upper structural support section, the lower structural support section, and the pair of connector sections of the support cradle comprise extrusions that are one of welded and structurally adhered to one another.

13. The mounting system of claim 2, further comprising a pair of upper snubbers coupled to respective laterally outer sides of the upper mounts in the pair of upper mounts and a pair of lower snubbers coupled to respective laterally outer sides of the lower mounts in the pair of lower mounts.

14. The mounting system of claim 13, wherein the pairs of upper and lower snubbers are attached to the laterally outer sides of the upper and lower mounts by way of the pairs of upper and lower fasteners, respectively.

15. The mounting system of claim 14, wherein each snubber in the pairs of upper and lower snubbers comprises a non-elastomeric component and an elastomeric component, and wherein the non-elastomeric component is configured to contact the respective upper or lower mount to which the snubber is attached upon translation of the respective upper or lower mount in a laterally outward direction.

16. The mounting system of claim 1, wherein:

each of the upper and lower mounts in the pairs of upper and lower mounts comprises a non-elastomeric outer shell;

a washer is provided for each of the upper and lower mounts; and the washer is fastened to the respective upper or lower structural support section, contacts the outer shell of the respective upper or lower mount in the port-starboard direction, and retains the respective upper or lower mount in the respective upper or lower structural support section.

17. The mounting system of claim 1, further comprising a cover that encloses the pair of lower mounts, port and starboard aft ends of the upper structural support section, and port and starboard aft ends of the lower structural support section.

18. A mounting system for mounting an outboard motor propulsion unit to a transom of a marine vessel, the outboard motor propulsion unit having a midsection with an upper end configured to support an engine system and a lower end configured to carry a gear housing, the mounting system comprising:

a support cradle having:

a head section configured for coupling to a transom bracket;

an upper structural support section extending aftward from the head section and configured to extend along opposite port and starboard sides of the midsection;

a lower structural support section suspended from the upper structural support section and configured for situating on the port and starboard sides of the midsection;

a first pair of extrusions respectively coupling port and starboard fore ends of the upper structural support section to port and starboard sides of the lower structural support section; and a second pair of extrusions respectively coupling port and starboard aft ends of the upper structural support section to the port and starboard sides of the lower structural support section;

a pair of upper mounts configured to couple the upper structural support section to the midsection proximate the engine system; and a pair of lower mounts configured to couple the lower structural support section to the midsection proximate the gear housing.

19. The mounting system of claim 18, wherein the head section and the upper structural support section of the support cradle are a first unitary casting and the lower structural support section is a second unitary casting.

20. The mounting system of claim 19, wherein the first and second pairs of extrusions are one of welded and structurally adhered to the upper and lower structural support sections.

* * * * *